US011431123B2

(12) United States Patent
Nakamura

(10) Patent No.: US 11,431,123 B2
(45) Date of Patent: Aug. 30, 2022

(54) CONNECTOR HAVING HOLDING MEMBER FOR HOLDING CONDUCTIVE MEMBER

(71) Applicant: HIROSE ELECTRIC CO., LTD., Kanagawa (JP)

(72) Inventor: Koichi Nakamura, Kanagawa (JP)

(73) Assignee: HIROSE ELECTRIC CO., LTD., Kanagawa (JP)

( * ) Notice: Subject to any disclaimer, the term of this patent is extended or adjusted under 35 U.S.C. 154(b) by 0 days.

(21) Appl. No.: 17/063,141

(22) Filed: Oct. 5, 2020

(65) Prior Publication Data

US 2021/0104836 A1 Apr. 8, 2021

(30) Foreign Application Priority Data

Oct. 8, 2019 (JP) ..... JP2019-185095

(51) Int. Cl.

| | |
|---|---|
| ***H01R 13/516*** | (2006.01) |
| ***H01R 12/77*** | (2011.01) |
| ***H01R 12/72*** | (2011.01) |
| ***H01R 13/502*** | (2006.01) |
| *H01R 12/79* | (2011.01) |
| *H01R 13/405* | (2006.01) |

(52) U.S. Cl.

CPC ..... *H01R 13/516* (2013.01); *H01R 12/724* (2013.01); *H01R 12/771* (2013.01); *H01R 12/774* (2013.01); *H01R 13/502* (2013.01); *H01R 12/79* (2013.01); *H01R 13/405* (2013.01)

(58) Field of Classification Search

CPC .. H01R 13/516; H01R 12/724; H01R 12/771; H01R 12/774; H01R 13/502; H01R 12/79; H01R 13/405

See application file for complete search history.

(56) References Cited

U.S. PATENT DOCUMENTS 8,840,415 B2 * 9/2014 Orris ..... H01R 13/025 439/495
2017/0373414 A1 * 12/2017 Sunada ..... H01R 12/721

FOREIGN PATENT DOCUMENTS

JP 6040333 B1 12/2016

* cited by examiner

*Primary Examiner* — Abdullah A Riyami
*Assistant Examiner* — Justin M Kratt
(74) *Attorney, Agent, or Firm* — Rankin, Hill & Clark LLP

(57) ABSTRACT

Provided is a connector including a housing and a holding member to be mounted to the housing, wherein the holding member holds a conductive member in which a reinforcement plate is arranged on the other surface on an opposite side of one surface on which a plurality of conductors arrayed adjacent to each other in a width direction is exposed planarly on one end side in a length direction, as a laminate of the conductive member and the reinforcement plate, and the holding member is laid across in a band-like manner along the width direction at an intermediate position between the one end side and the other end side in the length direction with respect to the laminate.

16 Claims, 14 Drawing Sheets

CONNECTOR HAVING HOLDING MEMBER FOR HOLDING CONDUCTIVE MEMBER

CROSS-REFERENCE TO RELATED APPLICATION

This application claims priority from Japanese Patent Application No. 2019-185095 filed with the Japan Patent Office on Oct. 8, 2019, the entire content of which is hereby incorporated by reference.

BACKGROUND

1. Technical Field

The present embodiment relates to a connector having a holding member for holding a conductive member, a mating connector to be used with the connector, and a connector device including the connector and the mating connector.

2. Related Art

Japanese Patent No. 6040333 discloses a connector of the above type, a mating connector, and a connector device, that is, an electrical connection device. The electrical connection device is configured as a device for electrically connecting a conductive member and a substrate, and includes a first connector and a second connector, which is a mating connector to which the first connector is to be connected.

The conductive member to be connected to the first connector is a conductive member having a plurality of conductors, is configured as a flexible cable or a flexible substrate having a plurality of insulated and coated conductors, and is provided with a plurality of conductors, a coated portion, and a reinforcement plate.

The reinforcement plate is a member provided at an end of the conductive member so that the connecting process is smoothly performed when the end of the conductive member is connected to the first connector, and the reinforcement plate is attached and fixed to one surface of the front and back surfaces at the tip of the end of the conductive member. At the end of the conductive member, a conductor exposure portion in which the ends of the plurality of conductors are exposed is provided as a portion in which the ends of the plurality of conductors are exposed on a surface opposite to the side to which the reinforcement plate is attached, of the flatly spreading front and back surfaces.

The first connector includes a conductive member mounting portion and a holding portion. The conductive member mounting portion is mounted by inserting the end of the conductive member along a connection direction, which is a direction perpendicular to a thickness direction and a width direction.

When mounted on the conductive member mounting portion, the end of the conductive member is inserted into an insertion opening of a tubular portion from a side opposite to the tip side of the conductive member mounting portion, and is sandwiched between a rib and a center pressing portion. When the end of the conductive member is mounted to the conductive member mounting portion, the end of the conductive member is annularly covered and enclosed by the tubular portion of the conductive member mounting portion. More specifically, the part of the end of the conductive member adjacent to the conductor exposure portion in the longitudinal direction of the conductive member is enclosed by the tubular portion.

When the first connector and the conductive member are connected, first, the end of the conductive member is inserted into the holding portion, and then the conductive member mounting portion is mounted to the end of the conductive member having been inserted into an insertion hole of the holding portion. Then, in a state where the conductive member is inserted into the insertion hole, and in a state where the conductive member mounting portion is mounted to the end of the conductive member, the conductive member mounting portion is fitted into and connected to the holding portion.

SUMMARY

A connector according to an embodiment of the invention includes a housing and a holding member to be mounted to the housing, wherein the holding member holds a conductive member in which a reinforcement plate is arranged on the other surface on an opposite side of one surface on which a plurality of conductors arrayed adjacent to each other in a width direction is exposed planarly on one end side in a length direction, as a laminate of the conductive member and the reinforcement plate, and the holding member is laid across in a band-like manner along the width direction at an intermediate position between the one end side and the other end side in the length direction with respect to the laminate.

DETAILED DESCRIPTION

Figure 1:
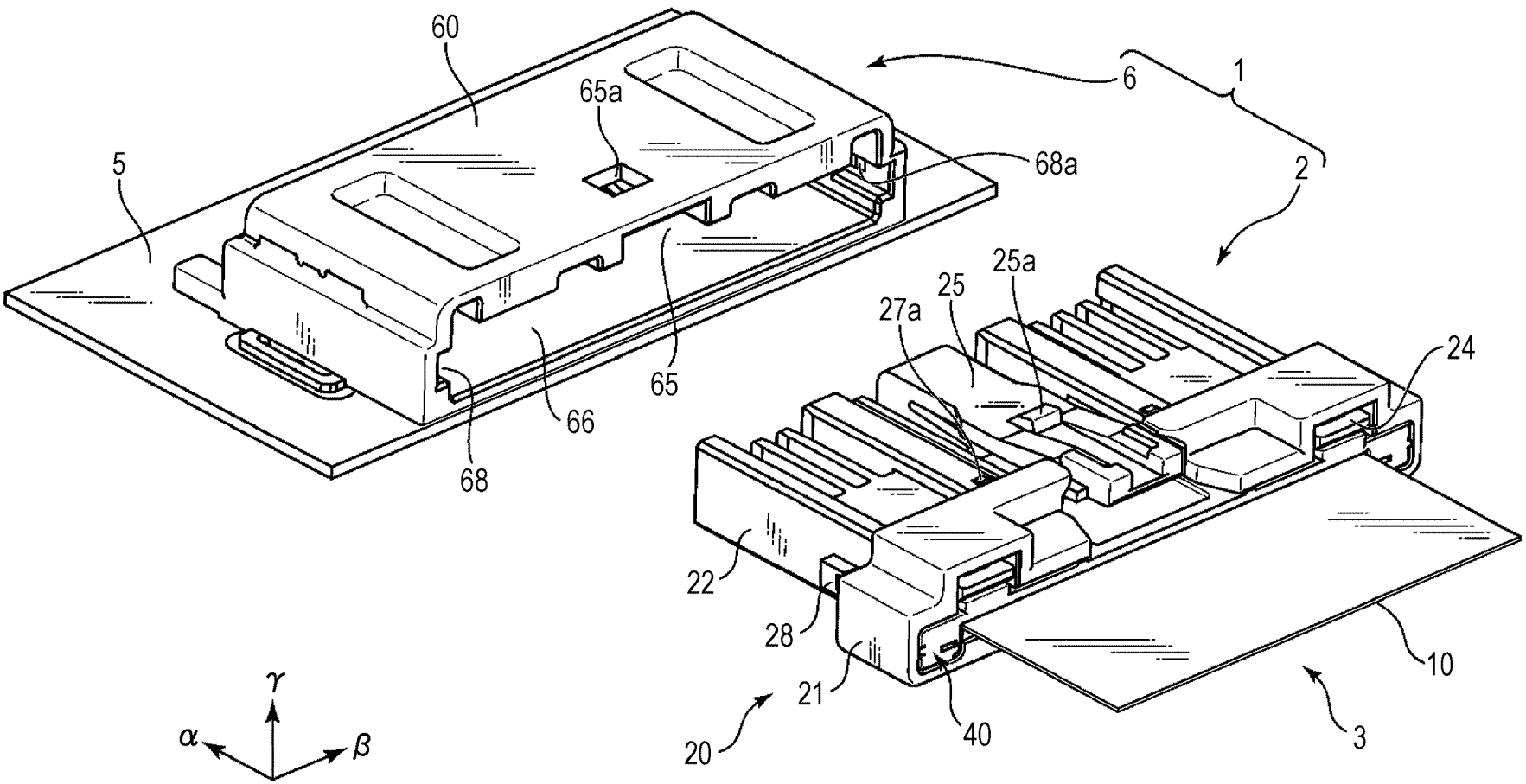
FIG. 1 is a perspective view of a connector device according to a preferred embodiment of the present embodiment, along with a peripheral member.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In the connector according to the related art described above, the end of the conductive member is mounted to the conductive member mounting portion so that the entire end is annularly covered and enclosed by the tubular portion of the conductive member mounting portion, and hence the mounting work is complicated, and the mounting member is large.

When the first connector and the conductive member are connected, first, the end of the conductive member is inserted into the holding portion, then the conductive member mounting portion is mounted to the end of the conductive member having been inserted into the insertion hole of the holding portion, and in a state where the conductive member is inserted into the insertion hole, and in a state where the conductive member mounting portion is mounted to the end of the conductive member, the conductive member mounting portion is fitted into the holding portion, and hence the connection work is very complicated.

The present embodiment has been made in order to solve such problems in the related art, and it is an object of the present invention to simplify the attaching work of the conductive member and to miniaturize the device in a connector having a holding member for holding a conductive member.

In order to solve the above problems, a connector according to an aspect of the present invention is a connector including a housing and a holding member to be mounted to the housing, wherein the holding member holds a conductive member in which a reinforcement plate is arranged on the other surface on an opposite side of one surface on which a plurality of conductors arrayed adjacent to each other in a width direction is exposed planarly on one end side in a length direction, as a laminate of the conductive member and the reinforcement plate, and the holding member is laid across in a band-like manner along the width direction at an intermediate position between the one end side and the other end side in the length direction with respect to the laminate.

According to the connector of this aspect, the holding member is laid across in a band-like manner along the width direction at an intermediate position between one end side and the other end side in the length direction with respect to the laminate including the conductive member, and it is hence possible to simplify the attaching work of the conductive member and to miniaturize the device.

In the connector of the above aspect, the laminate may have a locking projection projecting outward in the width direction at the end in the width direction, and the holding member may have a locking portion for locking the locking projection.

In the connector of the above aspect, when the holding member holds the laminate, the holding member may be continuously laid across in a band-like manner along the width direction only on either one of the one surface and the other surface of the laminate or may be continuously laid across in a band-like manner along the width direction on both the one surface and the other surface of the laminate.

In the connector of the above aspect, when the holding member is mounted to the housing, the substantially entire holding member may be accommodated in an accommodation space of the housing in the length direction.

In the connector of the above aspect, when the holding member holding the laminate is mounted to the housing, a portion of the conductive member held by the holding member and a portion of the conductive member positioned on the one end side in the length direction relative to a portion held by the holding member may be accommodated in an accommodation space of the housing.

In the connector of the above aspect, the reinforcement plate may be provided at a portion of the conductive member held by the holding member and a portion of the conductive member positioned on the one end side in the length direction relative to a portion held by the holding member.

The reinforcement plate may not be arranged in a portion of the conductive member positioned on the other end side in the length direction relative to a portion held by the holding member.

In the connector of the above aspect, the direction in which the connector is connected to a mating connector may be the same as the direction in which the holding member is accommodated in an accommodation space of the housing.

In the connector of the above aspect, an abutment projecting toward an inner wall of an insertion space so as to be able to abut against an inner wall of the insertion space when at least a part of the housing is inserted into the insertion space of a mating connector may be provided on an outer wall of the housing to be inserted into the insertion space.

In the connector according to the above aspect, the abutment may include a set of a first abutment and a second abutment provided on one surface and the other surface, respectively, of an outer wall of the housing, and the first abutment and the second abutment may be arranged to face each other in a thickness direction orthogonal to both the width direction and the length direction, and may be provided at substantially the same positions in the length direction and the width direction.

In the connector of the above aspect, a mating connector to be connected with the connector may include a plurality of mating terminals arrayed adjacent to each other along the width direction, and a mating housing molded integrally with the mating terminals, wherein the mating terminal has an elastic contact surface capable of coming into elastic contact with a conductor of the conductive member along the length direction when the housing of the connector is inserted into an insertion space of the mating housing of the mating connector, and the elastic contact surface may be bent in any direction intersecting with the length direction at a portion of the connector to come into contact with a conductor of the conductive member.

In the connector of the above aspect, the elastic contact surface is preferably bent in the thickness direction.

In the connector of the above aspect, the mating terminals are arrayed stepwise in the thickness direction, and a first mating terminal included in one terminal group arrayed in one step and a second mating terminal included in the other terminal group arrayed in the other step may be shifted from each other in the width direction, and may have substantially no overlap in the thickness direction.

Effects of Invention

According to an embodiment of the invention, it is possible to simplify the attaching work of the conductive member and to miniaturize the device in a connector having a holding member for holding a conductive member.

An exemplary embodiment of the present invention will be described below with reference to the accompanying drawings. Although only a preferred embodiment will be shown for convenience of explanation, these are not intended to limit the present invention.

Figure 2:
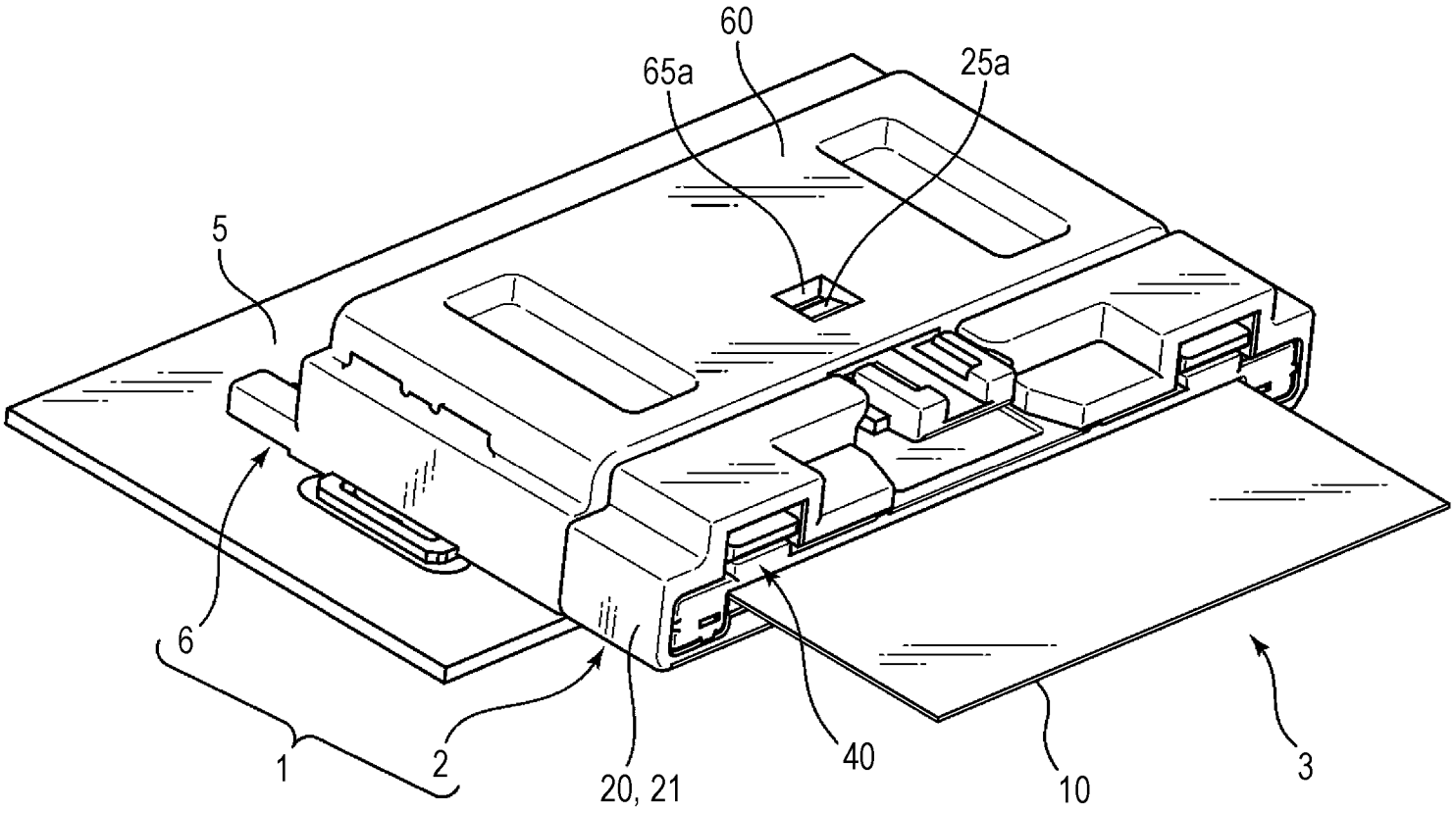
FIG. 2 is a perspective view showing a state after a connector and a mating connector are connected.
Figure 3:
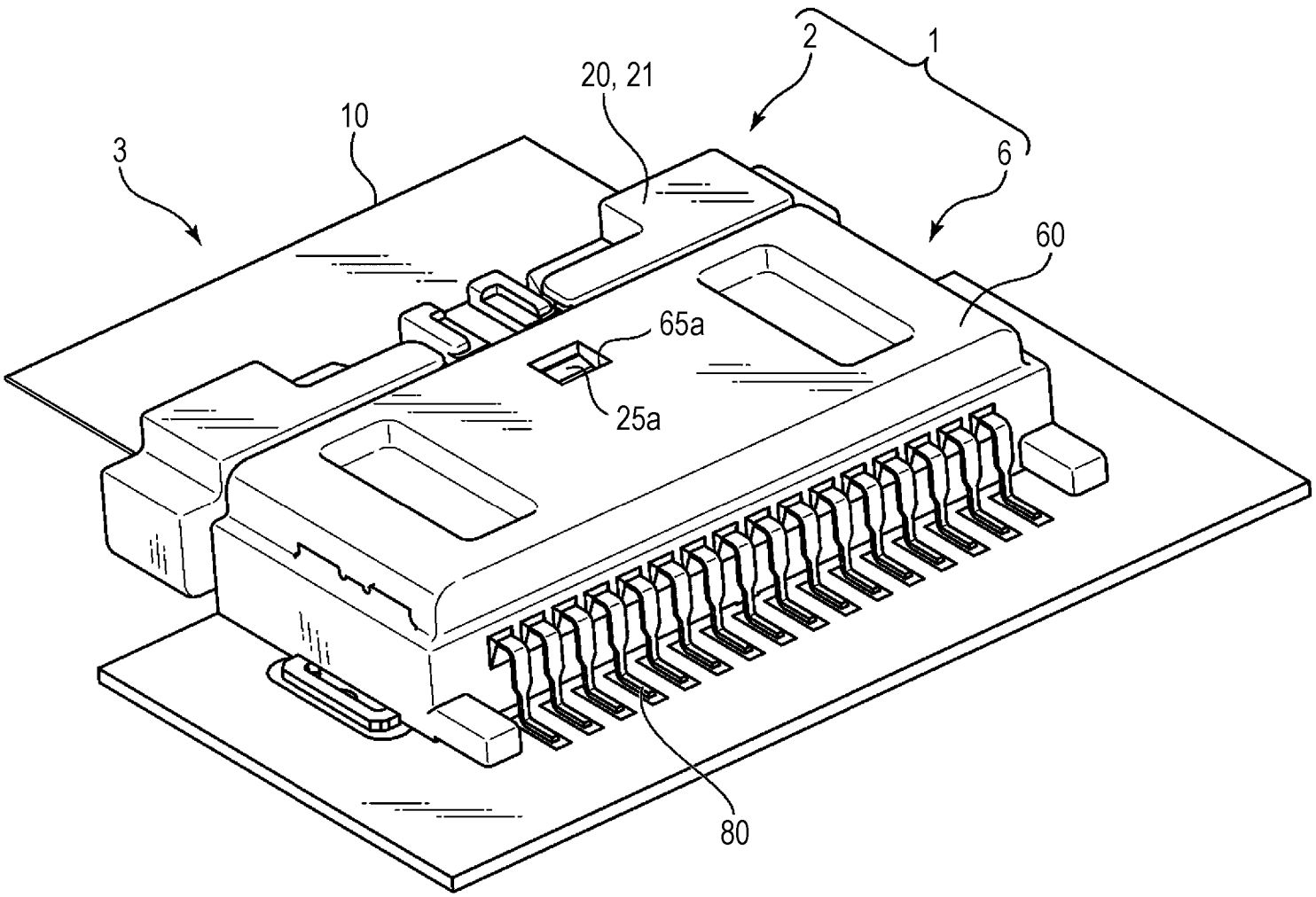
FIG. 3 is a perspective view showing the connector and the mating connector shown in FIG. 2 at a different angle.
Figure 4:
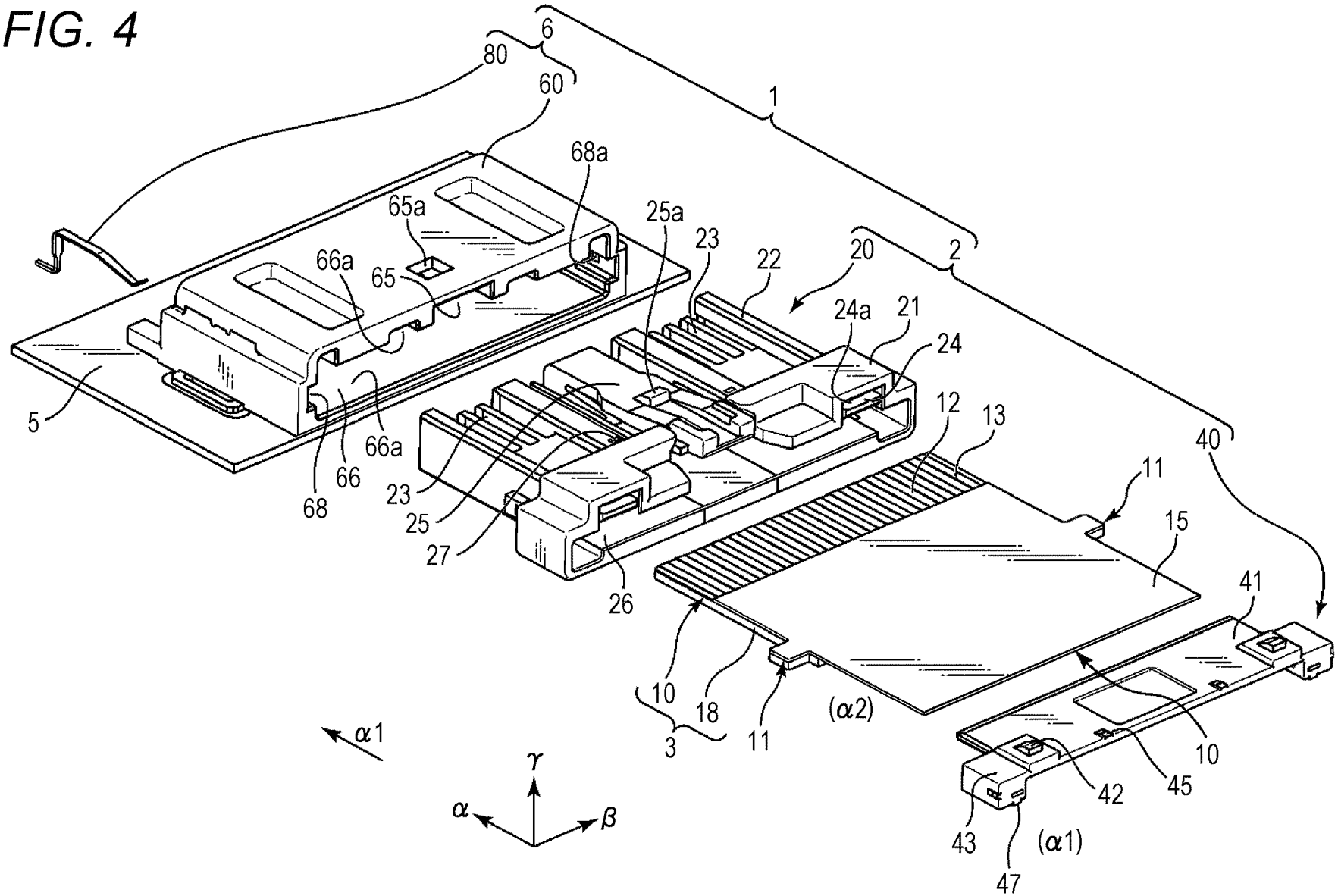
FIG. 4 is an exploded perspective view of the connector and the mating connector.

FIG. 1 shows a perspective view of a connector device according to a preferred embodiment of the present invention, along with a peripheral member. A connector device 1 includes a connector 2 and a mating connector 6, and FIG. 1 is a perspective view showing a state before the connector 2 and the mating connector 6 are connected, and FIGS. 2 and 3 are perspective views showing a state after the connector 2 and the mating connector 6 are connected at different angles with each other. FIG. 4 is an exploded perspective view of the connector 2 and the mating connector 6. FIG. 4 shows only one terminal 80 of the mating connector 6 for convenience.

The connector 2 is configured as a cable connector connected to a conductive member 10. As the conductive member 10, for example, a flexible cable or a flexible substrate can be used. The illustrated example shows a flexible substrate.

On the other hand, as the mating connector 6, a board-mounted connector mounted on a circuit board 5 is exemplified here. However, the present invention is not limited thereto, and for example, the mating connector 6 may be configured as a cable connector similarly to the connector 2.

Although here, the connector 2 and the mating connector 6 are connected by fitting, it is sufficient that as long as they can be connected to each other.

The connector 2 mainly includes a resin housing 20 and a resin holding member 40 to be mounted to the housing 20. In actual use, a laminate 3 where the conductive member 10 and a reinforcement plate 18 are laminated is fixed to the connector 2 through the holding member 40. When the connector 2 and the mating connector 6 are connected, an inserted portion 22 on the tip side of the housing 20 is inserted into an insertion space 66 of the mating connector 6, and this allows a plurality of conductors 13 provided on the conductive member 10 and a plurality of mating terminals 80 provided on the mating connector 6 to be correspondingly connected.

Figure 5:
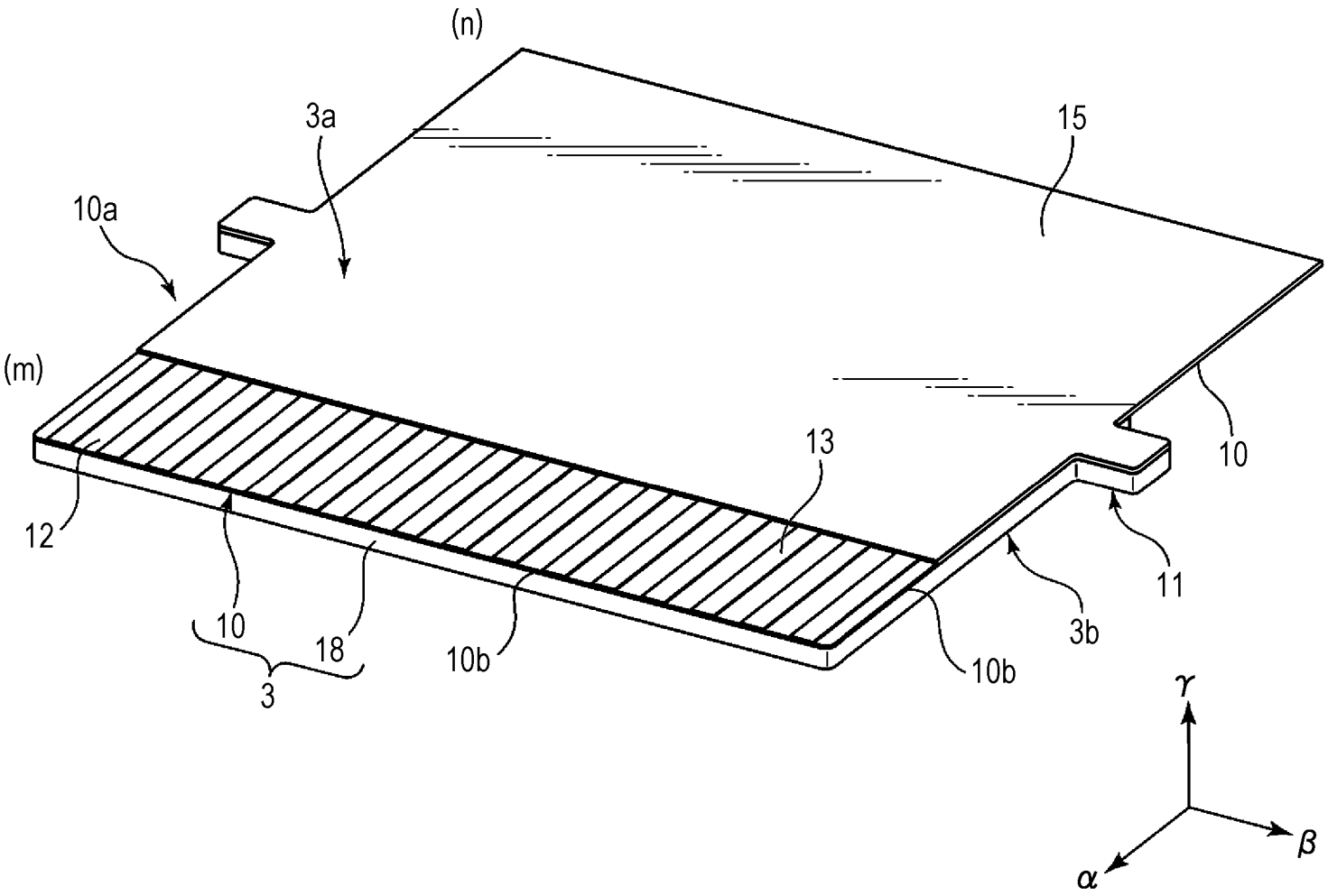
FIG. 5 is a perspective view of a laminate.
Figure 6:
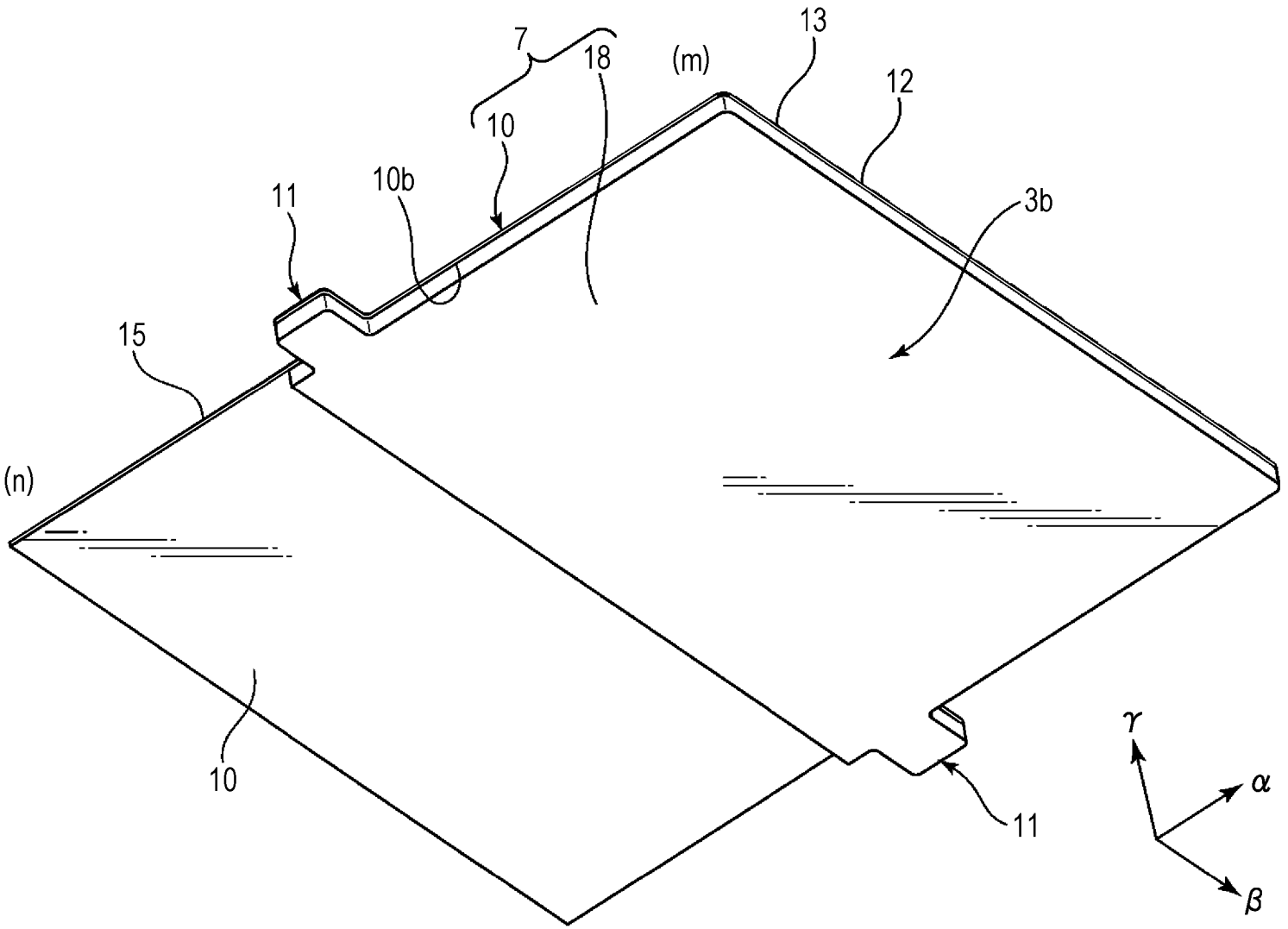
FIG. 6 is a perspective view of the laminate.

FIGS. 5 and 6 show perspective views of the laminate 3 in different orientations with each other. The laminate 3 integrally includes the conductive member 10 and the reinforcement plate 18 mainly.

The conductive member 10 may be considered to have a configuration similar to that of a common flexible substrate in the past. That is, the conductive member 10 includes an insulating plate-like resin base material 12, a plurality of stripe-like conductors 13 arrayed adjacent to each other along a width direction β on one plate surface of the resin base material 12, and a covering member 15 for covering the conductors 13 so as to planarly expose one end side (m) in a length direction α of these conductors 13. The conductive member 10 is a relatively thin member and has flexibility.

The reinforcement plate 18 can reinforce the strength of a part of the conductive member 10. The reinforcement plate 18 is a relatively thick plate-like member made of a resin material. The reinforcement plate 18 is arranged on the other surface 10*b* of the conductive member 10 opposite to one surface 10*a* where the conductor 13 is exposed. However, the reinforcement plate 18 is provided only in a partial region of the conductive member 10 on the one end side (m) where the conductor 13 is arranged in the length direction "α", and is not provided in any other part. The reinforcement plate 18 may or may not be fixed to the conductive member 10 with an adhesive or the like.

The end of each side of the laminate 3 in the width direction "β" is provided with a locking projection 11 projecting outward in the width direction "β" by using both the conductive member 10 and the reinforcement plate 18. These locking projections 11 can be locked by a predetermined portion of the holding member 40 when the laminate 3 is held by the holding member 40.

Figure 7:
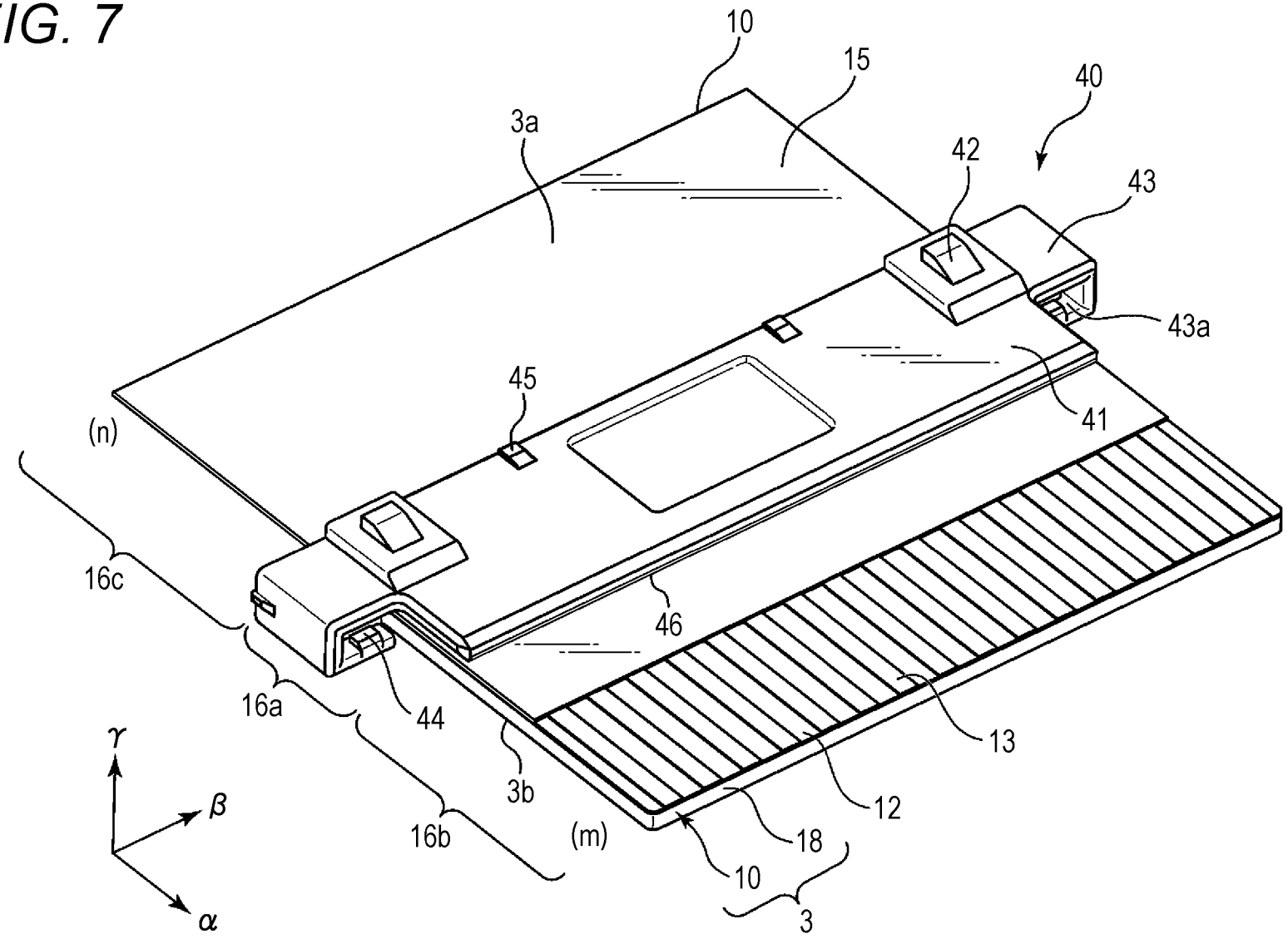
FIG. 7 is a perspective view of the laminate held by a holding member.
Figure 8:
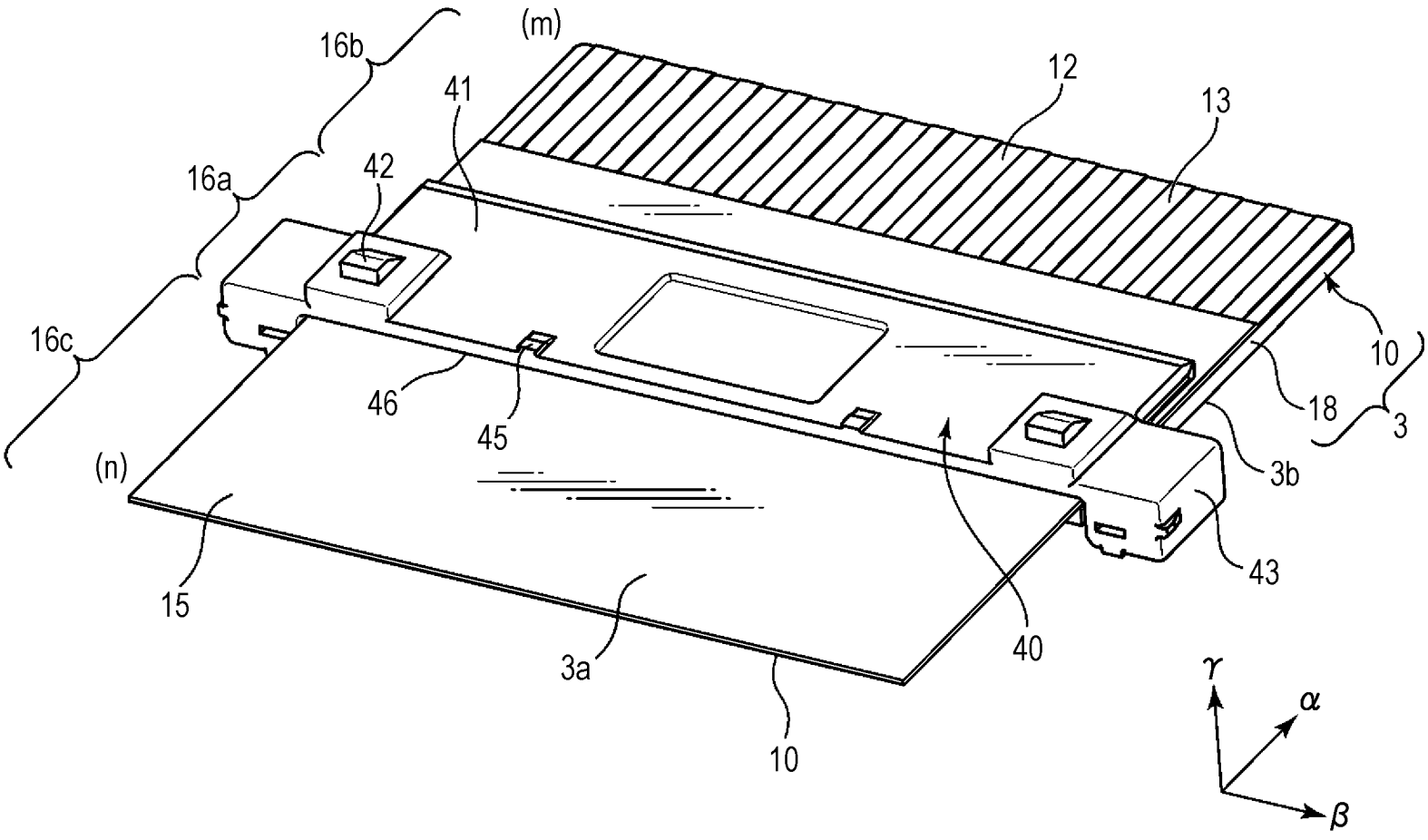
FIG. 8 is a perspective view of the laminate held by the holding member.
Figure 9:
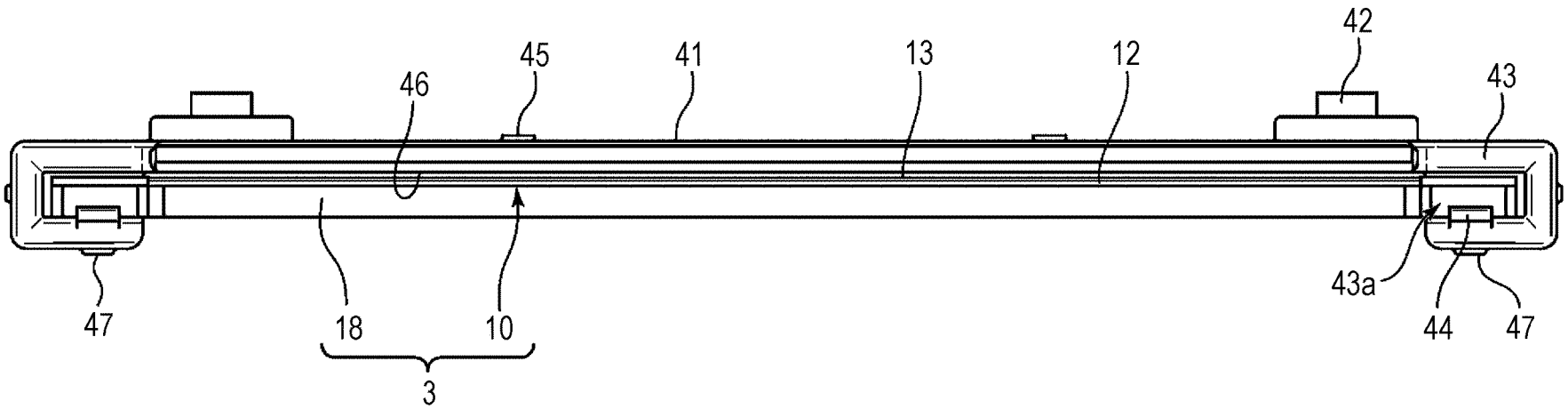
FIG. 9 is a front view of the laminate held by the holding member.

FIGS. 7 and 8 show perspective views of the laminate 3 held by the holding member 40 in different orientations from each other, and FIG. 9 shows a front view thereof.

The holding member 40 is mounted to the housing 20 while holding the laminate 3. Use of the holding member 40 allows the laminate 3, in particular, the conductor 13 included in the laminate 3, to be easily and reliably mounted to a predetermined position of the housing 20. When the holding member 40 is mounted to the housing 20, the substantially entire holding member 40 is accommodated in an accommodation space 26 of the housing 20 in the length direction "α" along a connection direction "α1" of the connector 2 and the mating connector 6.

Therefore, the connector device 1 does not increase in size.

The holding member 40 includes a band-like main body 41 and a locking portion 43 provided at each of both the ends of the main body 41 in the width direction "β". Since the main body 41 is band-like, it is a relatively small member.

When the laminate 3 is held by the holding member 40, the laminate 3 is in a state of being inserted into an insertion portion 46 of the main body 41 in the length direction "α", and the locking projection 11 formed on the laminate 3 is installed in a locking space 43*a* of the locking portion 43. The locking projection 11 is inserted into the locking space 43*a* from an opposite direction of the connection direction "α1", i.e., the one end side (m) toward the other end side (n), and is locked by a locking portion 44 provided near the entrance of the locking space 43*a*.

When the laminate 3 is held by the holding member 40, the main body 41 of the holding member 40 is continuously laid across in a band-like manner along the width direction "β" at an intermediate position between the one end side (m) and the other end side (n) in the length direction "α" on one surface 3*a* of the laminate 3. In this case, although the one end side (m) of the laminate 3 is not held by the holding member 40, the laminate 3 is reliably held by the holding member 40 due to the main body 41 laid across in a band-like manner and the locking portion 43 locking the locking projection 11. According to this aspect, since the intermediate portion of the laminate 3 in the length direction "α" is only held, it is hence possible to simplify the attaching work. In the illustrated embodiment, the holding member 40 is laid across only on the one surface 3*a* of the laminate 3, but conversely, the holding member 40 may be laid across only on the other surface 3*b* on the opposite side of the one surface 3*a*.

With holding the laminate 3, the holding member 40 is accommodated in the accommodation space 26 (see FIG. 4) of the housing 20, and is mounted to the housing 20. The accommodation direction with respect to the accommodation space 26 is the same as the connection direction "α1" in connecting the connector 2 and the mating connector 6. The accommodation space 26 accommodates only a portion 16*a* of the conductive member 10 held by the holding member 40 and a portion 16*b* (See FIGS. 7 and 8) of the conductive member 10 positioned on the one end side (m) relative to the portion 16*a* held by the holding member.

The reinforcement plate 18 is substantially provided only on the portion 16*a* of the conductive member 10 held by the holding member 40 in the longitudinal direction "α" and the portion 16*b* positioned on the one end side (m) relative to the portion 16*a* held by the holding member 40, and is not provided on a portion 16*c* positioned on the other end side (α2) relative to the portion 16*a* held by the holding member 40. Therefore, the portion 16*c* of the laminate 3 positioned on the other end side (α2) relative to the portion 16*a* held by the holding member 40, i.e., the portion provided with only the conductive member 10, can be deformed relatively easily and freely so as to fit to the internal structure of the housing.

In order to lock the holding member 40 to the housing 20 when the holding member 40 is accommodated in the accommodation space 26, a locking portion 42 projecting outward is provided on the outer surface of the main body 21 of the holding member 40. In order to sandwich the holding member 40 in the accommodation space 26, an abutment 45 to be abutted against a predetermined portion of the inner wall of the accommodation space 26 is provided in a state of projecting upward. By sandwiching the holding member 40 in the accommodation space 26, the influence of vibration can be effectively prevented. Similarly, the locking portion 43 of the holding member 40 on, for example, the bottom surface is provided with an abutment 47 having the similar function to that of the abutment 45 in a state of projecting downward. These abutments 45 and 47 have a predetermined length along the length direction "α", and, as the holding member 40 is accommodated in the accommodation space 26, a force is gradually applied between them.

Figure 10:
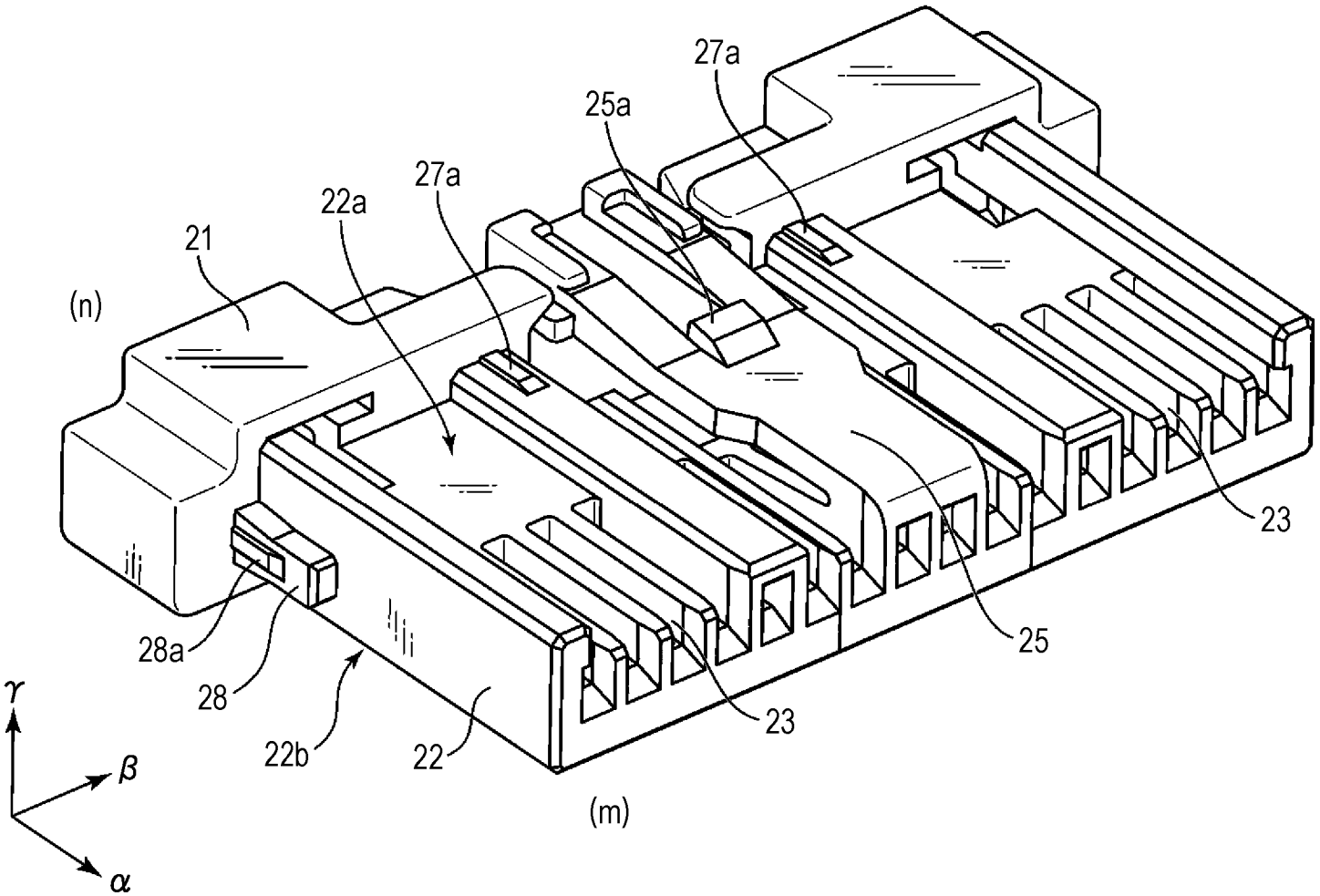
FIG. 10 is a perspective view of a housing.
Figure 11:
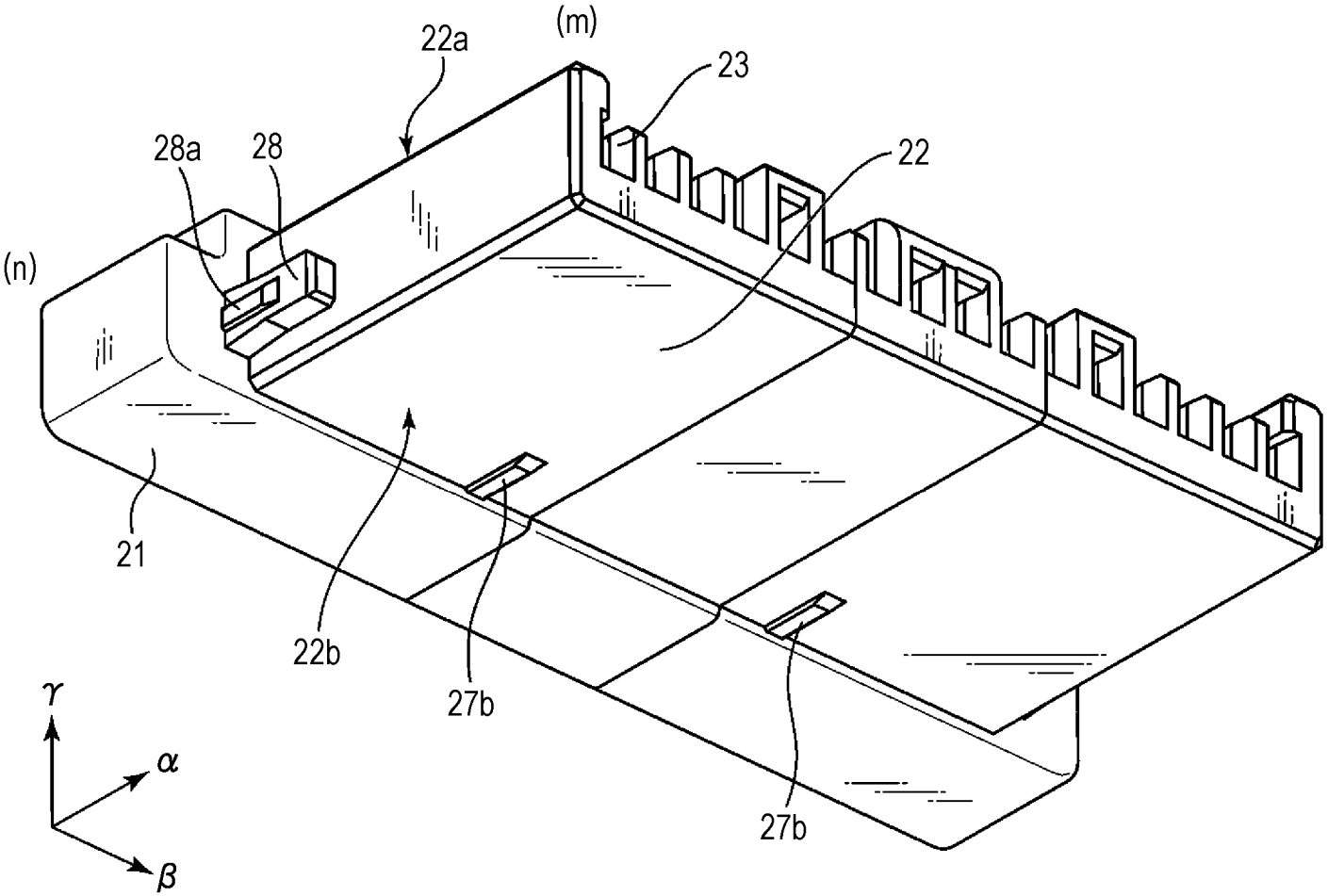
FIG. 11 is a perspective view of the housing.
Figure 12:
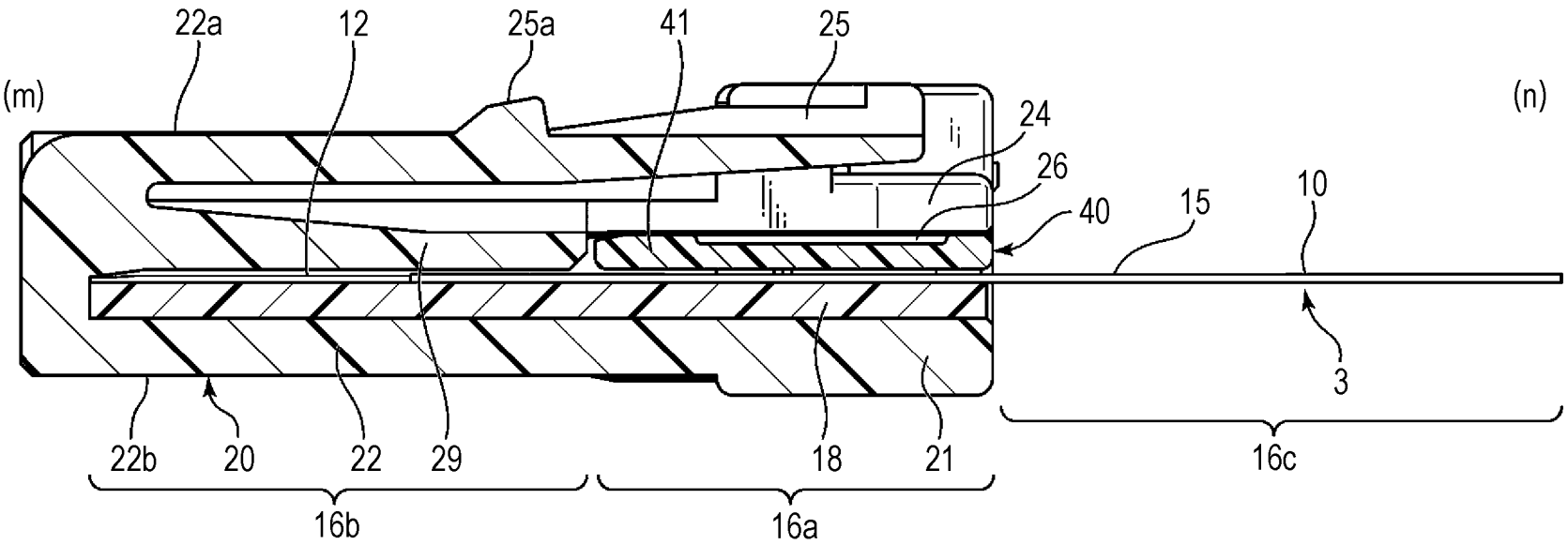
FIG. 12 is a cross-sectional view taken along line A-A of FIG. 1.

The housing 20 will be described with reference to FIGS. 10 to 12 in addition to FIGS. 1, 2, and 4. FIGS. 10 and 11 show perspective views of the housing 20 in different orientations from each other, and FIG. 12 shows a cross-sectional view taken along line A-A of FIG. 1. However, for convenience, FIG. 12 also shows the holding member 40 holding the laminate 3.

The housing 20 has a substantially frame-like main body 21 and an inserted portion 22 extending from the main body 21 along the connection direction "α1" with the mating connector 6. When the connector 2 and the mating connector 6 are connected, the inserted portion 22 is inserted into an insertion space 66 of the mating connector 6.

The accommodation space 26 for accommodating the holding member 40 is formed in the main body 21. A corresponding locking portion 24 to which the locking portion 42 provided to the holding member 40 can be locked is provided near an accommodation opening of the accommodation space 26. The corresponding locking portion 24 has a through hole 24*a* into which the locking portion 42 is fitted when the holding member 40 is accommodated in the accommodation space 26. When the holding member 40 is accommodated in the accommodation space 26, the locking portion 42 of the holding member 40 is locked to the through hole 24*a* of the corresponding locking portion 24. As described above, at this time, the holding member 40 is sandwiched in the accommodation space 26 by the abutment 45 provided in the holding member 40 and by the abutment 47 provided in the locking portion 43, and as a result, it is possible to effectively prevent the influence of vibration.

The main body 21 and the inserted portion 22 are communicated with each other in the length direction "α", and forming the accommodation space 26 inside thereof. The holding member 40 and the laminate 3 held by the holding member 40 are accommodated in the accommodation space 26. In order to sandwich the portion (16*b*) of the laminate 3 positioned on the one end side (m) relative to the portion 16*a* held by the holding member 40, an intermediate wall 29 for restricting the upper part of the laminate 3 is formed at a corresponding position in the accommodation space 26.

The one end side (m) of the inserted portion 22 in the length direction "α" is opened upward along the length direction "α", and as a result, the conductor 13 constituting the laminate 3 accommodated in the accommodation space 26 is exposed to the outside. When the inserted portion 22 is inserted into the insertion space 66 of the mating connector 6, the conductor 13 can come into contact with the mating terminal 80 provided in the mating connector 6 through these openings 23.

At the upper center part of the inserted portion 22, an elastic locking piece 25 is provided on a cantilever from the one end side (m) toward the other end side (n) in the length direction "α". At an intermediate position of the elastic locking piece 25 in the length direction "α", an upward projecting locking projection 25*a* is provided. The connector 2 is detachably locked to the mating connector 6 by using the elastic locking piece 25 and the locking projection 25*a*.

On the outer wall of the inserted portion 22, in particular, at the boundary between the main body 21 and the inserted portion 22 in the length direction "α", an abutment 27 is provided in a predetermined length along the accommodating direction "α1". The abutment 27 projects toward an inner wall 66*a* of the insertion space 66 so that the inserted portion 22 can abut against the inner wall 66*a* of the insertion space 66 when the inserted portion 22 is accommodated in the insertion space 66 of the mating connector 6. By providing the abutment 27, it is possible to sandwich the holding member 40 in the accommodation space 26, and to effectively prevent the influence by vibration.

The abutment 27 may include a set of a first abutment 27*a* and a second abutment 27*b* provided on one surface 22*a* and the other surface 22*b*, respectively, of the outer wall of the inserted portion 22. The first abutment 27*a* and the second abutment 27*b* are arranged to face each other in a thickness direction "γ" orthogonal to both the width direction "β" and the length direction "α", and are provided at substantially the same positions in the length direction "α" and the width direction "β". Here, "identical" means that the positions may be different to such an extent that it does not affect sandwiching. Thus, by providing the set of the first abutment 27*a* and the second abutment 27*b* at symmetrical positions, it is possible to sandwich the inserted portion 22 in the insertion space 66, and to effectively prevent the influence of vibration. Similarly, an abutment 28*a* may be provided in the width direction "β". The abutment 28*a* is provided on a positioning projection 28 projecting in the width direction "β".

Figure 13:
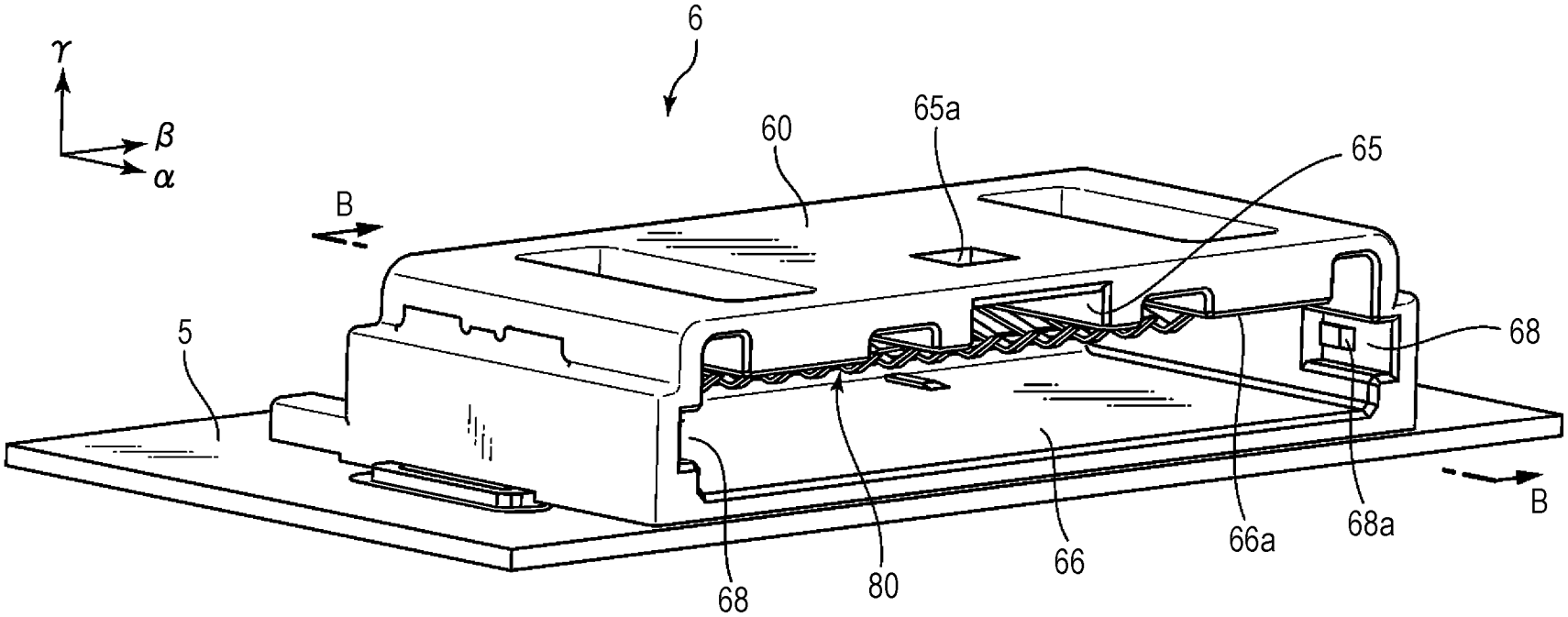
FIG. 13 is a perspective view of the mating connector.
Figure 14:
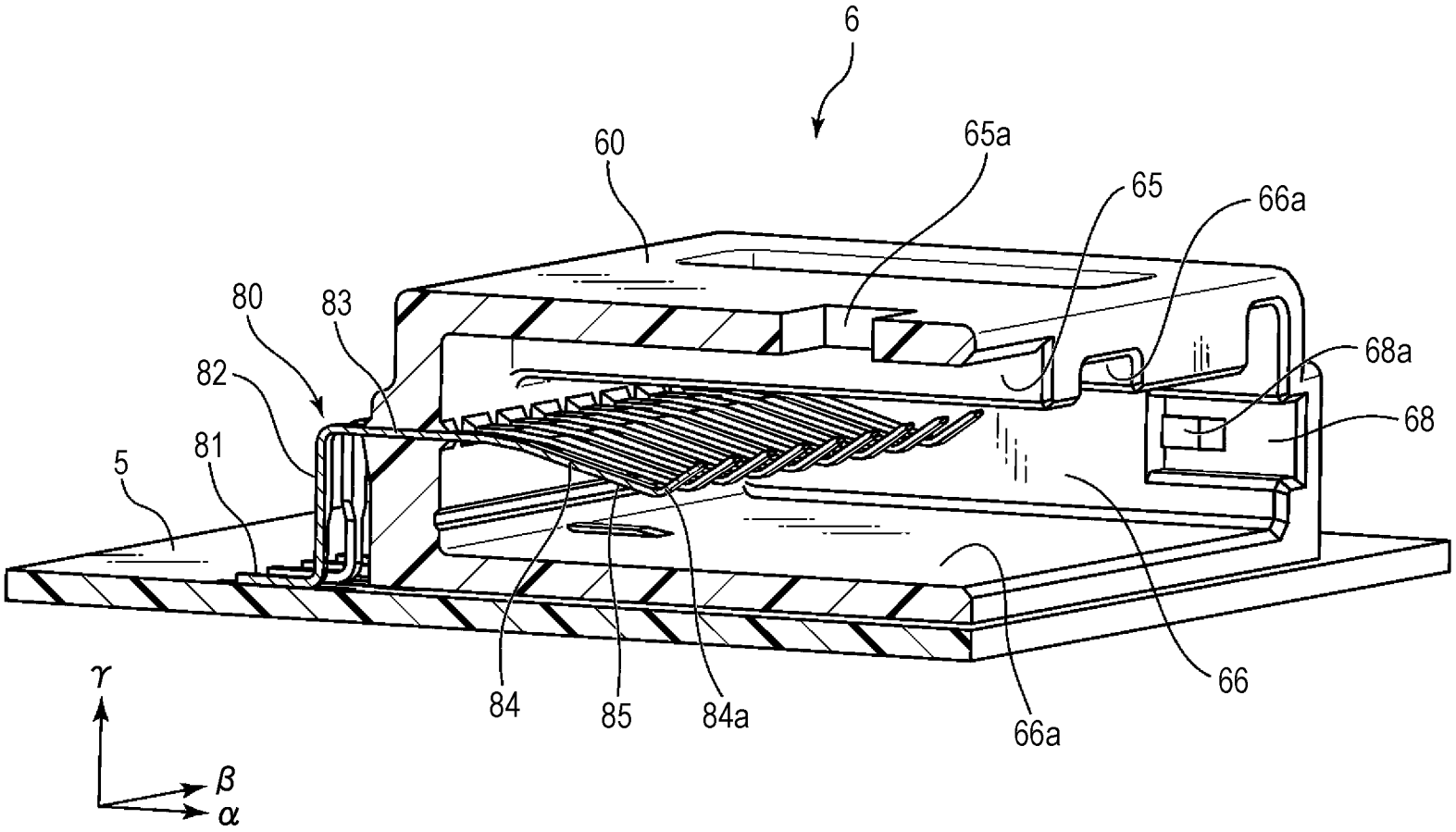
FIG. 14 is a cross-sectional perspective view taken along line B-B of FIG. 13.

FIG. 13 shows a perspective view of the mating connector 6, and FIG. 14 shows a cross-sectional perspective view taken along line B-B of FIG. 13. The mating connector 6 includes a resin mating housing 60, and the plurality of mating terminals 80 molded integrally with and fixed to the mating housing 60.

The mating housing 60 is a substantially box-like member having the insertion space 66 into which the inserted portion 22 of the connector 2 is inserted. In the insertion space 66, a locking groove 65 for accommodating the elastic locking piece 25 provided in the housing 20 of the connector 2 is provided on the upper inner wall of the insertion space 66 along the length direction "α". At the intermediate position of the locking groove 65 in the length direction "α", a locking through hole 65*a* where the locking projection 25*a* provided to the elastic locking piece 25 of the connector 2 is locked is provided in a state of penetrating the upper wall of the mating housing 60. When the inserted portion 22 provided in the housing 20 of the connector 2 is inserted into the insertion space 66, the locking projection 25*a* is fitted into the through hole 65*a* of the mating connector 6 by the elastic action of the elastic locking piece 25, and this causes the connector 2 to be locked to the mating connector 6.

In the insertion space 66, a recess 68 into which the projection 28 of the housing 20 of the connector 2 is fitted is further provided on the side inner wall along the length direction "α", and a depression 68*a* into which the abutment 28*a* is fitted is provided at the end of the recess 68 in the length direction "α". When the inserted portion 22 provided in the housing 20 of the connector 2 is inserted into the insertion space 66, the abutment 28*a* provided in the inserted portion 22 is fitted into the depression 68*a*, and the connector 2 is positioned to a predetermined position of the mating connector 6.

The plurality of mating terminals 80 is arrayed adjacent to each other in the mating housing 60 in the width direction "β". The mating terminal 80 mainly has a fixed portion 81 fixed to the circuit board 5 by using reflow or the like, a leg 82 erected from the fixed portion 81, and an elastic piece 84 extending along the length direction "α" in the insertion space 66, and the mating terminal 80 is molded and fixed by the mating housing 60 at a part of a molded portion 83 between the leg 82 and the elastic piece 84. The elastic piece 84 has an elastic contact surface 85 capable of coming into elastic contact with the conductor 13 of the conductive member 10 along the length direction "α" when the housing 20 of the connector 2 is inserted into the insertion space 66, and on one end side thereof, a contact portion 84*a* bent in a substantially V shape in any direction intersecting with the length direction "α", e.g., in the thickness direction "γ", is formed.

It is to be noted that the present invention is not limited to the above-described embodiment, and various other modifications can be made.

For example, it has been explained that when the holding member holds the laminate, the holding member is continuously laid across in a band-like manner along the width direction only on either one of one surface and the other surface of the laminate, but the holding member may be laid across on both the one surface and the other surface of the laminate.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A connector comprising:

a housing;

a holding member to be mounted to the housing;

a conductive member having one surface on which a plurality of conductors are exposed planarly on one end side of the conductive member in a length direction and another surface which is an opposite side of the one surface, the plurality of conductors being arrayed adjacent to each other in a width direction; and a reinforcement plate arranged on the another surface of the conductive member, wherein the holding member holds the conductive member and the reinforcement plate as a laminate of the conductive member and the reinforcement plate, and an entirety of the holding member is laid across in a band-like manner along the width direction at an intermediate position between the one end side and another end side of the conductive member in the length direction with respect to the laminate.

2. The connector according to claim 1, wherein the laminate has a locking projection projecting outward in the width direction at an end in the width direction, and the holding member has a locking portion for locking the locking projection.

3. The connector according to claim 1, wherein when the holding member holds the laminate, the holding member is continuously laid across in a band-like manner along the width direction only on either one of the one surface or the other surface of the laminate or is continuously laid across in a band-like manner along the width direction on both the one surface and the other surface of the laminate.

4. The connector according to claim 1, wherein when the holding member is mounted to the housing, the substantially entire holding member is accommodated in an accommodation space of the housing in the length direction.

5. The connector according to claim 1, wherein when the holding member holding the laminate is mounted to the housing, a portion of the conductive member held by the holding member and a portion of the conductive member positioned on the one end side in the length direction relative to the portion held by the holding member are accommodated in an accommodation space of the housing.

6. The connector according to claim 1, wherein the reinforcement plate is provided at a portion of the conductive member held by the holding member and a portion of the conductive member positioned on the one end side in the length direction relative to the portion held by the holding member.

7. The connector according to claim 6, wherein the reinforcement plate is not arranged in a portion of the conductive member positioned on the another end side in the length direction relative to the portion held by the holding member.

8. The connector according to claim 1, wherein a direction in which the connector is connected to a mating connector is same as a direction in which the holding member is accommodated in an accommodation space of the housing.

9. The connector according to claim 1, wherein an abutment is provided on an outer wall of the housing to be inserted into an insertion space of a mating connector, the abutment projecting toward an inner wall of the insertion space so as to be able to abut against the inner wall of the insertion space when at least a part of the housing is inserted into the insertion space of the mating connector.

10. The connector according to claim 9, wherein the abutment includes a set of a first abutment and a second abutment provided on one surface and another surface, respectively, of the outer wall of the housing, and the first abutment and the second abutment are arranged to face each other in a thickness direction orthogonal to both the width direction and the length direction, and are provided at substantially same positions in the length direction and the width direction.

11. The connector according to claim 1, wherein a mating connector to be connected with the connector includes a plurality of mating terminals arrayed adjacent to each other along the width direction, and a mating housing molded integrally with the mating terminals, and the mating terminal has an elastic contact surface capable of coming into elastic contact with a conductor of the conductive member along the length direction when the housing of the connector is inserted into an insertion space of the mating housing of the mating connector, and the elastic contact surface is bent in any direction intersecting with the length direction at a portion of the connector to come into contact with the conductor of the conductive member.

12. The connector according to claim 11, wherein the elastic contact surface is bent in a thickness direction orthogonal to both the width direction and the length direction.

13. The mating connector according to claim 11.

14. The connector according to claim 13, wherein the mating connector is a board-mounted connector.

15. A connector device comprising the connector according to claim 1 and a mating connector.

16. A connector device comprising the mating connector according to claim 11 and a connector.

* * * * *